United States Patent [19]

Starkey

[11] Patent Number: 4,953,437

[45] Date of Patent: Sep. 4, 1990

[54] METHOD AND APPARATUS FOR DIGITALLY GENERATING MUSICAL NOTES

[75] Inventor: David T. Starkey, San Diego, Calif.

[73] Assignee: Gulbransen Incorporated, Las Vegas, Nev.

[21] Appl. No.: 297,887

[22] Filed: Jan. 17, 1989

[51] Int. Cl.[5] ..... G10H 1/057; G10H 1/24; G10H 7/06; G10H 7/12

[52] U.S. Cl. ..... 84/603; 84/606; 84/607; 84/620; 84/627; 84/DIG. 10; 364/723

[58] Field of Search ..... 84/1.01, 1.09–1.13, 84/1.19–1.28, DIG. 9, DIG. 10, 603–608, 615–620, 626, 627; 364/723, 724.1

[56] References Cited

U.S. PATENT DOCUMENTS

| | | | |
|---|---|---|---|
| 4,246,823 | 1/1981 | Wachi et al. | 84/1.01 X |
| 4,334,281 | 6/1982 | Imazeki et al. | 364/723 |
| 4,479,411 | 10/1984 | Ishibashi | 84/1.01 |
| 4,536,853 | 8/1985 | Kawamoto et al. | 84/1.01 X |
| 4,633,749 | 1/1987 | Fujimori et al. | 84/1.01 |
| 4,635,520 | 1/1987 | Mitsumi | 84/1.01 X |
| 4,638,706 | 1/1987 | Nagashima et al. | 84/1.01 |
| 4,715,257 | 12/1987 | Hoshiai et al. | 84/1.01 |
| 4,719,833 | 1/1988 | Katoh et al. | 84/1.01 |
| 4,781,096 | 11/1988 | Suzuki et al. | 84/1.01 |
| 4,815,354 | 3/1989 | Kunimoto | 84/DIG. 10 |

*Primary Examiner*—Stanley J. Witkowski
*Attorney, Agent, or Firm*—J. Penrod

[57] ABSTRACT

An electronic musical instrument of the digital synthesis type that uses digital processing techniques to impart not only the desired harmonic structure and pitch, but also to impart the correct amplitude and envelope. Only after all of the harmonic structure processing, all amplitude scaling, and all panning/mixing has been performed in digital circuitry, are the four outputs converted by digital to analog converters into analog musical outputs. Part of the digital processing includes a digital scaling circuit using a barrel interpolator to scale each sample from ½ to 31/32 and a shift right register to scale each sample between 1 and 1/32,768.

5 Claims, 4 Drawing Sheets

METHOD AND APPARATUS FOR DIGITALLY GENERATING MUSICAL NOTES

BACKGROUND OF THE INVENTION

The invention relates to a keyboard musical instrument, and more particularly to a method and apparatus for digitally generating musical notes in an electronic musical instrument.

There are two known approaches to digitally generating musical notes. The first approach encompasses musical instruments which generate musical tones from one or more continuous varying inputs which are subsequently shaped by essentially linear networks into a musical output. The second approach encompasses musical instruments which generate musical tones from a sequence of discrete data samples. These tones are converted from processed data samples into analog signals by digital to analog converters, and are scaled or amplified to the desired output level. The instruments that use this later approach are referred to as digital synthesizers.

U.S. Pat. No. 4,602,545 by David Starkey issued Jul. 29, 1986 entitled DIGITAL SIGNAL GENERATOR FOR MUSICAL NOTES, describes a type of digital synthesizer. The inventor of this patented digital synthesizer is also the inventor of the present invention, and the disclosure of U.S. Pat. No. 4,602,545 is hereby incorporated by reference. This known digital synthesizer uses waveforms which are stored in memory (either ROM or loaded RAM) as wavetables. The wavetables contain samples of the waveform and are adequate to define the harmonic structure, which is defined beforehand and selected by a musical stop switch or other similar device. This known synthesizer reads the stored samples in a time sequence according to the pitch of the note selected on a keyboard or other similar device. Further, this digital synthesizer uses an interpolator to interpolate the value of the stored waveform between samples, which reduces the amount of granularity noise present in the audio output because of using discrete samples of the waveform. As mentioned in this patent, the interpolator gives the reduced granularity of larger memories and larger stored sample sizes, without the cost of additional memory or the need of more lines in the address bus.

As good as this digital signal generator is, it still has some limitations. The granularity or smoothness of the waveform as it changes to subsequent points of the waveform is reduced, but it is not removed. Another problem results from the multiplying digital to analog convertor used to perform the envelope shaping after the interpolator section has determined the waveform. The multiplying digital to analog converters use a lookup table in memory which is controlled by the keyboard stop and the key played signals to determine the attack and decay portions of the envelope shape. The $X^2$ piecewise approximation of the attack and decay portions of the envelope are sometimes difficult approximations to make from the selections available in the lookup table because of the parabolic nature of the function. This often results in noticable increases in noise and distortion of the musical output.

It is an object of this invention to provide a digital signal generator of the digital synthesizer type that has a reduced granularity of the interpolated waveform.

It is another object of this invention to provide a digital signal generator with an envelope shaping system that generates less noise and distortion.

It is another object of this invention to provide a digital signal generator that exponentially approximates the attack and decay portions of each note envelope.

It is another object of this invention to provide a digital signal generator that uses digital scaling of the interpolated waveforms to perform amplitude variation and envelope shaping.

SUMMARY OF THE INVENTION

Briefly stated, in accordance with one aspect of the invention, the aforementioned objects are achieved by providing a digital signal generator for musical notes comprising a keyboard including stop for producing first selection signals each of which indicates the selection of a defined set of harmonic structures, key-played sensors for producing second selection signals each of which indicates the selection of a note having a predetermined pitch and a predetermined harmonic structure, and key velocity sensors for producing third selection signals each of which indicates the selection of a predetermined amplitude and a predetermined envelope of the note. The digital signal generator also has a first memory for storing a first plurality of digital samples representing a waveform having a selected harmonic structure, and a second memory for storing a second plurality of digital samples representing an envelope having a selected amplitude and shape. A digital computing device samples the stored samples in the first memory in response to the second selection signals. The digital computing device includes a barrel interpolator controlled by the digital computing device for repetitively interpolating between successive samples read from the waveform stored in the first memory means and producing an interpolated output. This interpolated output represents more accurately than does either of such successive samples a point on the stored waveform instructed by the second selection signal. The barrel interpolator comprises a digital adder having a first input connected to receive samples read from the waveform stored in the first memory means, a first latch under clock control connected between the output and a second input of the adder for dividing an output sum signal by two and coupling the resulting signal to the second input of the adder, and a second latch connected to receive the output of the adder for producing the interpolated output following a predetermined number of interpolation cycles. The barrel interpolator is further controlled by the digital computing device for repetitively interpolating between the interpolated output fed back to the first input of the adder and a null value connected to the first input of the adder and producing a scaled output having the amplitude and envelope shape instructed by the third selection signal as well as the pitch and harmonic structure instructed by the first and second selection signals. A digital to analog convertor converts the scaled output produced by the barrel interpolator into an analog signal which can be transduced into audible music in a known way.

BRIEF DESCRIPTION OF THE DRAWINGS

While the specification concludes with claims particularly pointing out and distinctly claiming the subject matter which is considered to be the invention, it is believed that the description will be better understood when taken in conjunction with the following drawings in which:

DETAILED DESCRIPTION

Figure 1:
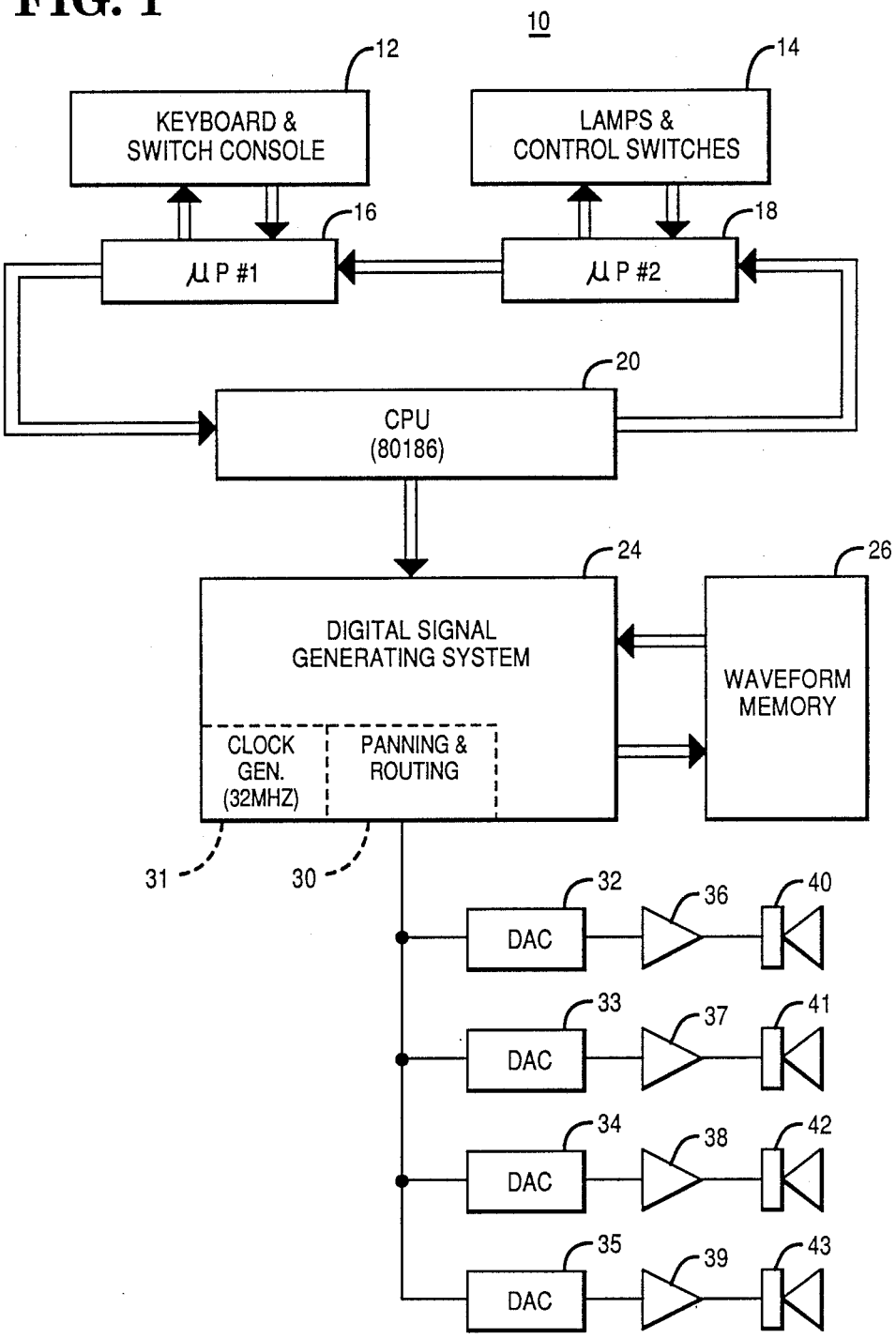
FIG. 1 is a block diagram of an electronic musical instrument embodying the invention.

Referring to FIG. 1, there is shown an electronic musical instrument 10 embodying the invention. The instrument 10 is of the digital synthesis type such as an electronic organ or an electronic piano. An electronic organ embodiment of the electronic musical instrument would have an accompaniment keyboard and/or a pedal keyboard (not shown) in addition to a keyboard console 12 and auxillary display and control console 14. An electronic piano embodiment of the electronic instrument has a keyboard console 12 and auxillary display and control console 14. An accompaniment keyboard (not shown) is contemplated, but is not necessary for the electronic piano embodiment of the invention. Both embodiments of the electronic musical instrument 10 have a number of stops or effects switches that define distinctive harmonic structures, one structure for each note that is played on the keyboard 12. Although the invention is applicable to electronic organs or electronic pianos, for reasons which shall be apparent later, the remainder of the detailed description will concern an electronic piano, which is the preferred embodiment.

When a stop is activated or a key is played, a selection signal is issued from the console to indicate a change in the status of the stop or key in use. The stop selection defines a set of harmonic structures. The key played/-key released selection signal selects the pitch and the correct harmonic structure within the set of harmonic structures for the note that corresponds to the key. Additionally, the key velocity is sensed and a selection signal selects an amplitude which corresponds to the velocity of the key. In a piano, the higher the key velocity, the harder the strings are struck and the greater amplitude of sound generated by the strings. Thus, the key velocity is sensed to give the electronic musical instrument 10 the characteristics of an electronic piano.

The synthesis of an appropriate waveform and its reproduction at the required fundamental pitch and at the required amplitude can then be instructed by operation of a stop and/or a key. These requirements are satisfied in the system of FIG. 1 by the combination of a programmed computer 20 to which the keyboard console 12, on which associated stops and effects controls are mounted, and the auxillary console 14 on which various gain and panning controls are mounted, are coupled by microprocessor #1 16, and microprocessor #2 18, in a distributed processing arrangement. The computer 20, also called the central processing unit, interacts with microprocessors 16, 18 in a manner consistent with instructions set forth by the manufacturer of the microprocessors 16, 18 and the computer 20. In a preferred embodiment, the computer 20 is a Model 80186 manufactured by Intel Corporation.

Microprocessors 16, 18 include means for interrogating the status of all of the switches representing contacts of the keyboard console 12 and auxillary console 14 and for writing appropriate selection signals into a memory of computer 20 when any change of status resulting from stop tab or key operation is detected. Computer 20 then issues instructions to a digital signal generating system 24 to sample a stored waveform in waveform memory 26 at the rate required to assign the desired fundamental pitch to the note corresponding to the operated key. Further instructions from computer 20 instruct the digital signal generating system 24 to perform amplitude and envelope scaling using digital sampling and interpolation techniques. The outputs of the digital signal generating system 24 can be individually scaled by a first value selectable between one-half to thirty-one thirty-seconds, a second value which shifts the digital output by up to fifteen places to the right thereby multiplying by a range of 1 to 1/16, 384 in order to produce the desired amplitude and envelope.

The digital signal generating system 24 has sixty-four digital oscillators and is capable of simultaneously generating sixty-four notes in a time shared fashion. The output of each digital oscillator is applied to a panning and routing generator 30 which digitally mixes and combines the sixty-four oscillators according to panning and routing information (stored therein by the computer 20) into four channels. The four channels are demultiplexed by the panning and routing subsystem 30 into four digital to analog converters 32–35 using timing information from clock generator 31. Since the amplitude processing and the mixing for each channel has already been provided by digital circuitry, the digital to analog convertors 32–35 are connected to respective fixed gain amplifiers 36–39 and to loudspeakers 40–43 without the need for analog gain controls.

Figure 2:
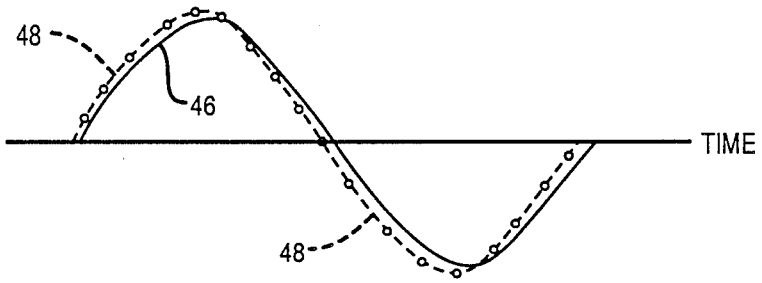
FIG. 2 is a sketch useful for understanding how an interpolator operates.

Before proceeding with a detailed description of the digital signal generator 24 and the panning and routing subsystem 30, wherein the inventive features reside, reference is made to FIG. 2 which illustrates the operation of an interpolator as in the digital signal generating system 24 as it interpolates between two successive samples in one of the wave tables stored in waveform memory 26. Utilizing a sine wave 46 as the sampled waveform (not the usual waveshape of a typical electronic piano), in accordance with the first interpolation technique of the present invention, the successive samples are essentially connected by straight-line segments 48, shown in dotted lines slightly displaced from the sine wave 46 to avoid confusion. It is seen that even the limited number of sample values 48 in this example, closely approximates the sine wave represented by the stored samples. Obviously, as the number of samples increases, the straight-line segments will even more closely approximate the sine wave. The error is even further minimized, in accordance with the invention, by interpolating between successive sample points as instructed by phase and frequency information from the computer 20 (not shown in FIG. 2), which has the effect of increasing the effective number of sample values and thereby improving the approximation.

Figures 3, 3A:
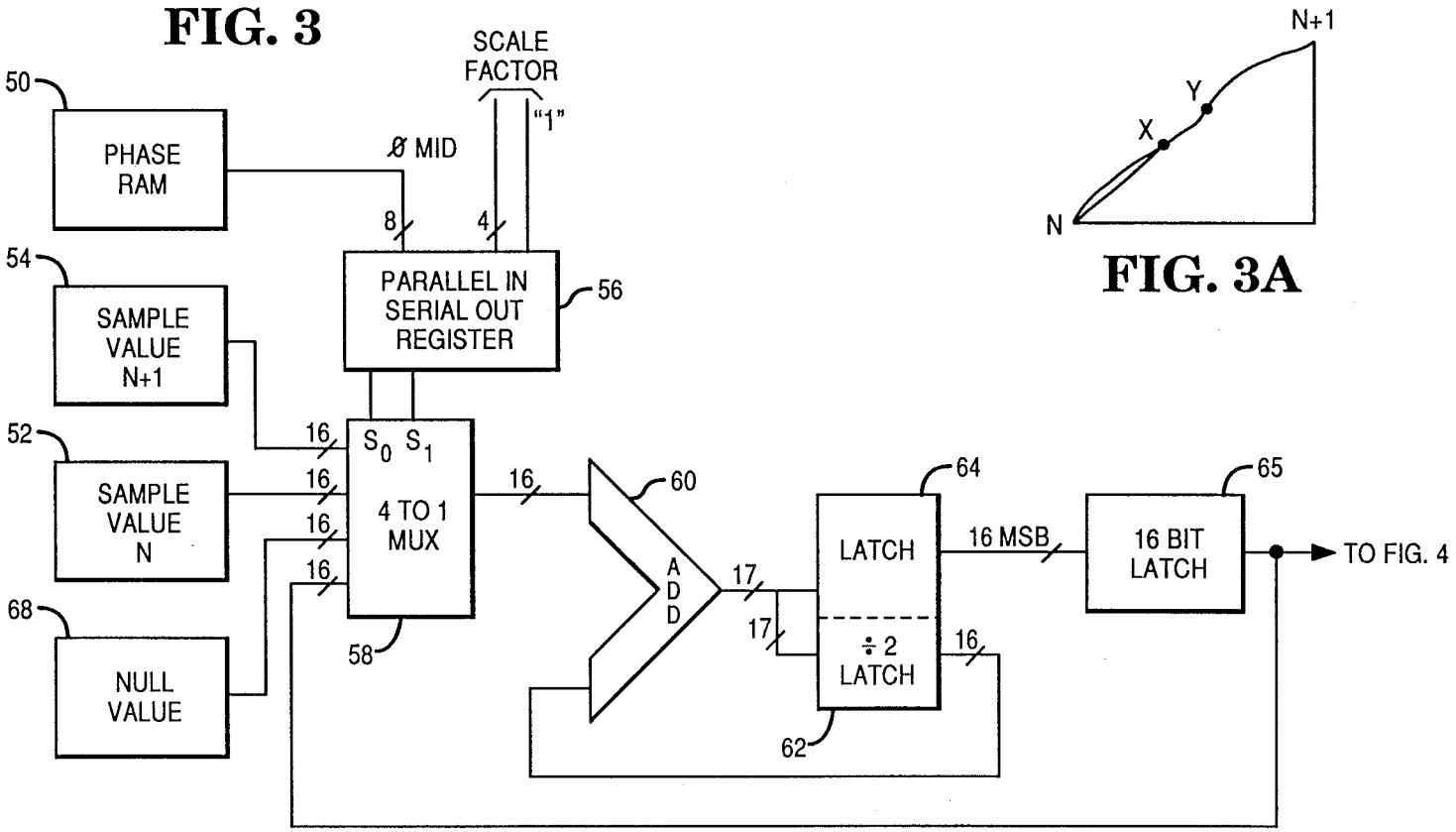
FIG. 3 is a block diagram of a musical note generator of the electronic musical instrument of FIG. 1.
FIG. 3A is a sketch useful to the understanding of the operation of the interpolator during note generation.

The general function of the digital signal generator 24 having been described, the operation of the components of the system that achieve this function will now be considered in greater detail with reference to FIG. 3. Contacts and other outputs for all keys, switches, velocity sensors, and gain controls provided in the consoles vary in number with the size and complexity of the electronic piano. The address and status of every contact and control is scanned by microprocessors 16, 18 for any change in status at a rate that is transparent to the user, and any changes in status are communicated to the computer 20. The response of computer 20 to scan data indicating that a change in the console selection signals has been made is to draw on the appropriate program for the synthesis of the required complex waveshape in digital signal generator 24, the preferred embodiment of which is shown in block diagram form at the upper left portion of FIG. 3.

Frequency information signals corresponding to the basic frequencies of musical tones to be generated which, in turn, correspond to the tonal pitch of a played key, are coupled from the computer memory (not shown) to the input of a phase RAM 50. The phase RAM 50 accumulates twenty two bits of significant phase information for a digital oscillator which has 256 samples (the amount of significant phase information changes with the number of samples in the oscillator is other than 256). Eight bits of the significant phase information are used to fetch one or the other "previous" amplitude sample N, or a "next" amplitude sample N+1 from a waveshape memory (not shown) and stored in sample value registers 52 and 54. The waveshape memory, which may take the form of 256 by 16 bit RAM, stores 256 (usually) samples of a previously developed musical tone wave shape which includes a large number of higher harmonic components to provide the desired tonal quality. A parallel-in-serial-out (PISO) register 56 is loaded with eight bits from phase RAM 50 which, under computer control first couples the least significant of the eight bits to the control input S of a four-to-one multiplexer 58 which, in turn, connects either registers 52 or 54. The interpolator, which is called a barrel interpolator, further includes an adder 60 connected to receive at a first input a signal from the output of multiplexer 58, a clocked divide by two latch 62 connected between the output of the adder 60 and a second input to the adder, and a sixteen bit latch 64 connected between the output of the adder 60, a third input to the four-to-one multiplexer 58 and a subsequent sixteen bit latch 65.

In operation, the output of adder 60 is divided by two in latch 62, the sixteen bits of the signal being shifted as they are transferred from the output of the latch 62 to the second input of the adder 60 that it is coupled to, which effectively divides the latch input by two. The effect of this operation is to add one-half of the adder output produce by the previous cycle of the interpolator (the cycle being controlled by the PISO register 56) to a new sample coming into the adder from four-to-one multiplexer 58. For every previous amplitude sample N stored in register 52, the digital oscillator addresses and retrieves both samples corresponding to a next amplitude sample N+1. Although both sample N and sample N+1 are shown physically connected to four-to-one multiplexer 58, it is understood that only one of these may be selected at a time. For example, if sample N is stored in register 52 and sample N+1 is stored in register 54, interpolation between them is accomplished by cycling the interpolator eight times under control of the eight bits of data in the phase accumulator and designated in the drawing as $\phi_{mid}$.

More particularly, and with reference now also to FIG. 3A, the least significant of the eight bits is first applied to the select bit $S_0$ of the multiplexer (the other select bit $S_1$ is held at zero), and if the value of $S_0$ is a zero, the multiplexer 58 applies sample N from register 52 to the input of adder 60; this sample may appear on the waveform represented by the stored samples at the location depicted in FIG. 3A. If, on the other hand, the value of this first bit is one, the multiplexer 58 applies sample N+1 to the input of the adder 60 instead; this sample appears at another position on the stored waveform as shown in FIG. 3A. After that signal is applied to the adder 60 and a certain amount of time has been allowed for settling, the output of the adder 60 is clocked back into other input of the adder 60 after having been divided by two by clocked latch 62. The sample point X is the interpolation resulting from the first cycle, which falls between sample points N and N+1 and is displaced from the stored waveform (this assumes that this is the first cycle of the interpolation between N and N+1, if this were the first cycle of the oscillator then the adder 60 and latch 62 would be initially cleared). At the conclusion of this first cycle PISO register 56 applies the next most significant of the eight bits which, in turn, selects either the sample N or the sample N+1 as before and that sample is then delivered via multiplexer 58 to the first input of adder 60 and following a predetermined settling time, during which the sample is added to the last previous value divided by two, is clocked into latch 62 and coupled to the other input of the adder 60. In this example, sample N+1 would have been selected and the approximation based upon sample X and sample N+1 to produce the sample point designated Y. This process is repeated for each of the six remaining of the eight bits in PISO register 56, and at the conclusion of the eighth cycle, the output of the adder 60 is an interpolated sample, which is clocked into sixteen bit latch 64. Thus, it is seen that the difference in the values of samples N and N+1 (in the shown example) is interpolated to eight bits such that the interpolated sample represents to a high degree of accuracy, the value of a sample lying between samples N and N+1, as called for by the phase RAM 50. This process is repeated for each of the stored sample points (i.e. for eight-bit interpolation for each) under control of the changing phase information from phase RAM 50.

The operation just described is similar to that of a barrel multiplier previously used in microprocessors, but differs in one important aspect. In a classic barrel multiplier the value of the smaller of the two samples interpolated between is forced to be zero. If the value of the smaller of the two interpolated samples N and N+1 were forced to be zero, the desired interpolation would not result. This described modification to the known barrel multiplier provides a better waveshape generator than is obtainable by other techniques. The present waveshape generator is even an improvement over the inventor's previous patent (U.S. Pat. No. 4,602,545) because of the increased precision of sixteen bit architectures and memory buses, but is very similar in the interpolation between sample points.

After the eight cycle of phase interpolation, a second process of interpolation, called the scaling process, begins on the phase interpolated sample in sixteen bit latch 64. The output of latch 64 is connected to subsequent latch 65. The output of latch 65 goes to the input of a shift right register 68 (not shown in FIG. 3), and is also fed back to an input of the four-to-one multiplexer 58. For this process, the PISO register 56 has five additional bits of information for interpolation. Four of these bits are a "mantissa" of a quasi floating point number, the ordinate of which is explained later, and a fifth, most significant bit is always connected to logic one. For this operation the $S_1$ select bit is held to logic one, while the output of the PISO register 58 is switched to either a logic zero or one depending on the mantissa value stored in the register by computer 20. If the bit connected to $S_0$ is a logic zero, then four-to-one multiplexer 56 applies the value zero from the Null Value register 68 to the first input of the adder 60, which, as described before, after a specific settling time will be added with half of the phase interpolated value and that sum will be stored in the latch 64. This barrel interpolation is continued for the next four most significant bits of the amplitude mantissa. This second interpolation effectively multiplies the phase interpolation result by $(A_L+16)/32$ where $A_L$ is a four bit binary number of the range 0 to 15. Thus, this mantissa can scale the phase interpolated sample in 1/32 gradations between one-half and thirty-one thirty-seconds. Since most of the circuitry used is already existing, the main expenditure of this scaling circuit is the five cycle of interpolation time required for the 1/32 gradations. After the end of the fifth scaling interpolation cycle, the scaled output is clocked from sixteen bit latch 64 to sixteen bit latch 65 in response to the clock generator in the digital signal generator.

Figure 4A:
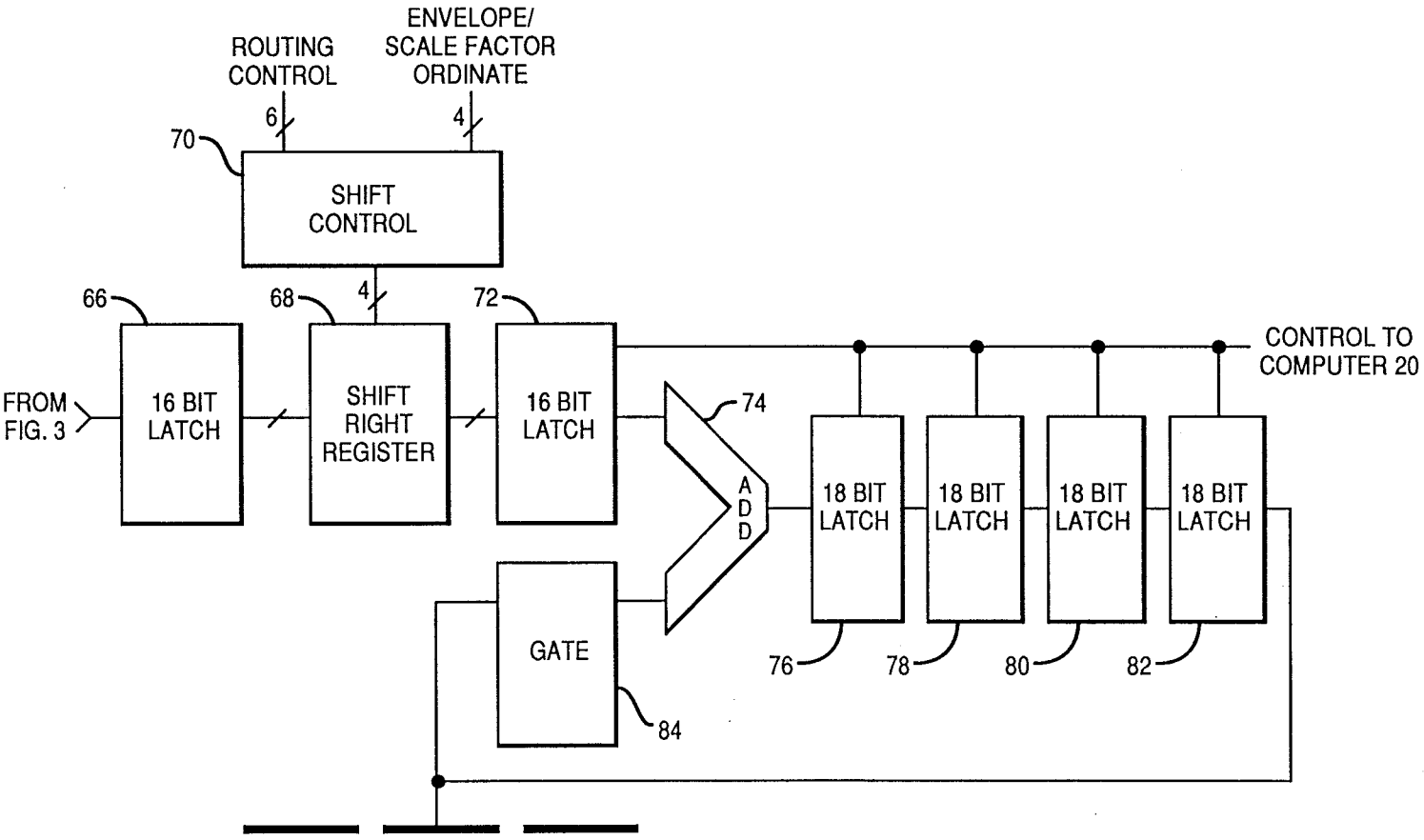
FIGS. 4A and 4B when joined along the dashed lines form block diagram of the digital accumulating outputs, each with a respective digital to analog convertor.
Figure 4B:
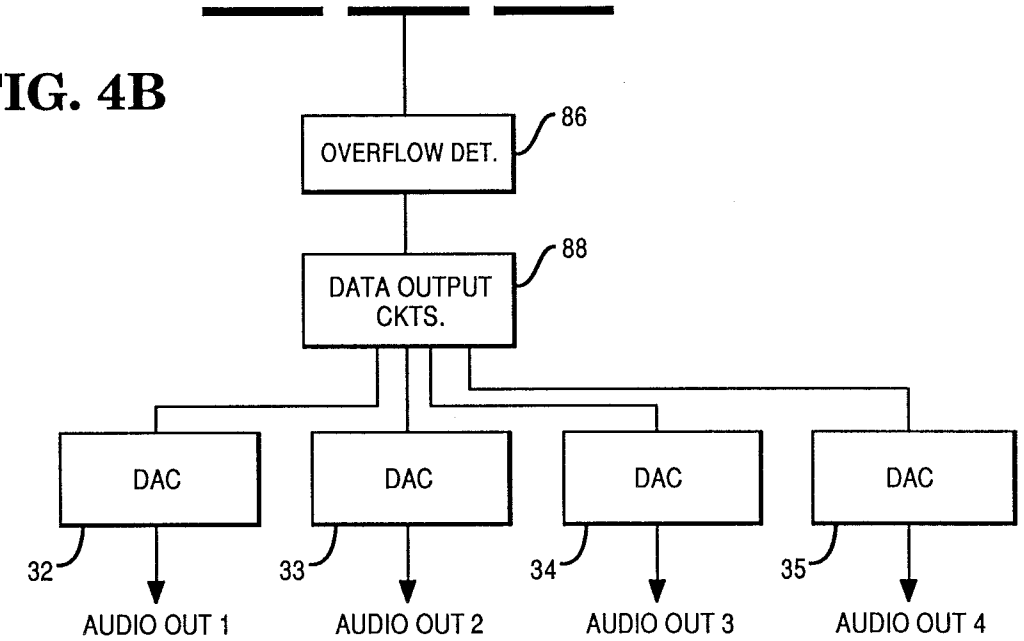

Referring now to FIGS. 4A and 4B the remainder of the invention will be described. From sixteen bit register 65, the interpolated and scaled sample is clocked into programmed shift right register 68. Programmed shift right register 68 is controlled by shift control memory 70.

For each of the sixty-four oscillators in digital signal generator 24, there is stored in a panning control memory within the shift control memory 70 a four bit panning control word and a two bit routing control word. Each of the panning control bits instructs the shift right register 68 to either not shift the present digital sample at all or to shift the digital sample fifteen places. This is essentially a switching function to either add this sample to the next available rotating sum, or add a null sample to the next available sum. The two bit routing control bits, if the panning bit for the next available output sum is a logic one, can instruct the shift right register 68 to shift the current contents by one, two, or three places and thereby multiply the digital oscillator value in register 68 by one-half, one-fourth, or one-eighth respectively.

In shift control memory 70 are also sixty-four addressable eight bit memory locations, one for each of the digital oscillators. Stored in the four most significant bits of each location is the scaling factor ordinate, which since it has four bits can instruct the shift right register to shift to the right 0 to 15 places. In the preferred embodiment, a binary value of 1111 on the four control lines of shift right register 68 during this phase of processing indicates that no shift is to be performed. A binary value of 1110 would indicate that one shift to the right was instructed, and so on. Each shift right represents a multiplier of a power of two. Thus, the total scaling that can be achieved by using both the mantissa and the ordinate as described above is:

$$2^{A_S}(A_L+16)/32$$

where $A_S$ is a four bit binary number between 0 and 15, $A_L$ is a four bit binary number between 0 and 15, and, 16 and 32 are decimal numbers.

Thus, the variation possible is from one-half to 32,768 for a scaling factor. After scaling in shift register 68, the completed sample value is clocked into sixteen bit register 72.

The description thus far has been concerned with producing only one output waveshape at a time; however, the preferred embodiment has the capability of almost simultaneously generating sixty-four waveshapes, that is to say, the electronic musical instrument embodies sixty-four digital oscillators like the one shown in FIGS. 2, 4A and 4B. The output of these sixty-four oscillators is summed by adder 74 into four sum outputs rotatingly stored in four eighteen bit latches 78–82 under the control of the clock generator of the digital signal generator. Gate 84 either re-circulates the rotating sum for the next oscillator output in latch 72 to be added to using two's complement arithmetic, or to mask the circulating output to all logic zeroes in order to clear the sum for a new start.

As the four digital oscillator sums circulate, they are tested for overflow conditions by overflow detector 86. If an overflow is not indicated by the top three bits of the two's complement extended value, then the rotating sum is demultiplexed by the Data Output Circuit 88 to one of four digital to analog converters 32–35 which represent the left, right, reverberation and the effect analog outputs.

The outputs of the DACs 32–35 do not have to have analog gain controls, since both the shape and the overall level of the signal amplitude has been processed in the digital processing by the amplitude scaling mantissa and ordinate. Because the digital oscillator clock rate is very fast, i.e. primary clock rate for the oscillators is thirty-two megahertz, more of the processing can be done digitally. Thus, the amplitude and envelope can have computer programs to control their shapes because of variations with key velocity sensors, oscillator slide controllers, digital master gain controllers in addition to the key played, and key up signals processed previously. And, because the processing is being performed by logical additions and logical shifting the processing is much faster, thereby reducing the amount of amplitude change per scaling operation and amount of amplitude granularity. Furthermore, the mantissa and ordinate scaling factor operation multiplications make the simulation of attack envelopes and decay envelopes both faster and more natural than the previously used $X^2$ multiplying DAC instruments.

Thus, there has been described a new apparatus for providing a digital signal generator for an electronic musical instrument. It is contemplated that other variations and modifications of the apparatus of applicant's invention will occur to those skilled in the art. All such variations and modification which fall within the spirit and scope of the appended claims are deemed to be part of the present invention.

I claim:

1. A digital signal generator for musical notes comprising:

keyboard means including stop means for producing first selection signals each of which indicates the selection of a predetermined set of harmonic structures, key-played means for producing second selection signals each of which indicates the selection of a note having a predetermined pitch and one of the set of predetermined harmonic structures, and key velocity means for producing third selection signals each of which indicates the selection of a predetermined amplitude and a predetermined envelope of the note;

first memory means for storing a first plurality of digital samples representing a waveform having the selected one of the harmonic structures;

second memory means for storing a second plurality of digital samples representing the selected envelope with its predetermined amplitude and shape;

digital computer means for sampling the samples stored in said first memory means in response to said second selection signals including:

barrel interpolator means controlled by said digital computer means for repetitively interpolating between successive samples read from the waveform stored in said first memory means and producing a plurality of interpolated output samples each of which represents more accurately than does either successive samples a point on the stored waveform instructed by its second selection signal;

said barrel interpolator means comprising a digital adder having a first input connected to receive samples read from the waveform stored in said first memory means, a first latch under clock control connected between the output and a second input of said adder for dividing an output sum signal by two and coupling the resulting signal to the second input of said adder, and a second latch connected to receive the output of said adder for producing said plurality of interpolated output samples, each of said interpolated samples is produced following a predetermined number of interpolation cycles;

said barrel interpolator means further controlled by said digital computer means for repetitively interpolating between said interpolated output fed back to the first input of said adder and a null value connected to said first input of said adder, and producing a plurality of scaled output samples having the amplitude and shape of the selected envelope; and means for converting the plurality of scaled output samples produced by said barrel interpolator into an analog signal.

2. A digital signal generator according to claim 1, wherein said converting means includes:

an envelope generator controlled by said digital computer means for generating digital signals representing amplitude values of a composite waveform.

3. A digital signal generator according to claim 1, wherein said converting means includes a digital to analog converter that converts the plurality of scaled output samples into said analog signal which can be musically reproduced by a loudspeaker.

4. A digital signal generator for musical notes comprising:

digital computer means having first input means including a plurality of stops for selecting one of a set of harmonic structures, and second input means including a plurality of keys for producing selection signals each of which indicates the selection of a note having a predetermined pitch and one of the set of harmonic structures;

memory means for storing a first plurality of digital samples representing a waveform having the selected harmonic structure;

means for producing a completed sample output following a predetermined number of interpolation cycles, including a source of digital values representative of phase angle increments controlled by said digital computer means and responsive to a change in said selection signals for sampling the samples stored in said memory means at a fixed clocking rate for selecting a note, and further including interpolator means for repetitively interpolating between successive samples read from said waveform memory means and producing a plurality of completed sample outputs, each of which represents more accurately than does either of such successive samples a point on the stored waveform instructed by the selection signals, said interpolator means including a digital adder, having a first input connected to receive samples read from the waveform stored in said memory means, a first latch under clock control connected between the output and a second input of said adder for dividing an output sum signal by two and coupling the resulting signal to the second input of said adder, and a second latch connected to receive the output of said adder as the plurality of completed sample outputs; and means for converting the plurality of completed sample outputs produced by said interpolator means into an analog output.

5. A digital signal generator according to claim 4, wherein said converting means includes a digital to analog converter that converts the plurality of completed sample outputs into said analog signal which can be musically reproduced by a loudspeaker.

* * * * *